US006809692B2

(12) United States Patent
Puente Baliarda et al.

(10) Patent No.: US 6,809,692 B2
(45) Date of Patent: Oct. 26, 2004

(54) ADVANCED MULTILEVEL ANTENNA FOR MOTOR VEHICLES

(75) Inventors: Carles Puente Baliarda, Barcelona (ES); Edouard-Jean-Louis Rozan, Barcelona (ES)

(73) Assignee: Advanced Automotive Antennas, S.L., Barcelona (ES)

( * ) Notice: Subject to any disclaimer, the term of this patent is extended or adjusted under 35 U.S.C. 154(b) by 0 days.

(21) Appl. No.: 10/274,853

(22) Filed: Oct. 17, 2002

(65) Prior Publication Data

US 2003/0112190 A1 Jun. 19, 2003

Related U.S. Application Data

(63) Continuation of application No. PCT/ES00/00148, filed on Apr. 19, 2000.

(51) Int. Cl.[7] ..... H01Q 1/32
(52) U.S. Cl. ..... 343/713; 343/711; 343/879
(58) Field of Search ..... 343/700 MS, 711, 343/712, 713, 878, 879, 893

(56) References Cited

U.S. PATENT DOCUMENTS

| | | | | |
|---|---|---|---|---|
| 3,521,284 | A | 7/1970 | Shelton, Jr. et al. | 343/727 |
| 3,599,214 | A | 8/1971 | Altmayer | 343/713 |
| 3,622,890 | A | 11/1971 | Fujimoto et al. | 325/375 |
| 3,683,376 | A | 8/1972 | Pronovost | 343/5 PP |
| 3,818,490 | A | 6/1974 | Leahy | 343/725 |
| 3,967,276 | A | 6/1976 | Goubau | 343/752 |
| 3,969,730 | A | 7/1976 | Fuchser | 343/779 |
| 4,024,542 | A | 5/1977 | Ikawa et al. | 343/702 |
| 4,131,893 | A | 12/1978 | Munson et al. | 343/700 MS |
| 4,141,016 | A | 2/1979 | Nelson | 343/858 |
| 4,471,358 | A | 9/1984 | Glasser | 343/18 B |
| 4,471,493 | A | 9/1984 | Schober | 455/90 |
| 4,504,834 | A | 3/1985 | Garay et al. | 343/749 |
| 4,543,581 | A | 9/1985 | Nemet | 343/702 |
| 4,571,595 | A | 2/1986 | Phillips et al. | 343/745 |
| 4,584,709 | A | 4/1986 | Kneisel et al. | 455/78 |
| 4,590,614 | A | 5/1986 | Erat | 455/270 |
| 4,623,894 | A | 11/1986 | Lee et al. | 343/700 MS |
| 4,673,948 | A | 6/1987 | Kuo | 343/792.5 |
| 4,730,195 | A | 3/1988 | Phillips et al. | 343/792 |
| 4,839,660 | A | 6/1989 | Hadzoglou | 343/715 |
| 4,843,468 | A | 6/1989 | Drewery | 358/140 |

(List continued on next page.)

FOREIGN PATENT DOCUMENTS

| | | |
|---|---|---|
| DE | 3337941 | 5/1985 |
| EP | 0096847 | 12/1983 |
| EP | 0 297 813 | 1/1989 |

(List continued on next page.)

OTHER PUBLICATIONS

Hansen, R.C., "Fundamental Limitations in Antennas," Proceedings of the IEEE, vol. 69, No. 2, pp. 170–182 (Feb. 1981).

(List continued on next page.)

*Primary Examiner*—Shih-Chao Chen
(74) *Attorney, Agent, or Firm*—Jones Day

(57) ABSTRACT

The invention relates to an antenna for a motor vehicle, having the following parts and characteristics: a) a transparent window covered with a transparent, optically conductive plate on at least one side of any of the window material plates; b) a multilevel structure printed on the conductive plate. The multilevel structure consists of a set of polygonal elements pertaining to one same class, preferably triangles or squares; c) a transmission line powering two conductors; d) a similar impedance in the power supply point and a horizontal radiation diagram in at least three frequencies within three bands. The main advantage of the invention lies in the multiband and multiservice performance of the antenna. This enables convenient and easy connection of a simple antenna for most communication systems of the vehicle.

36 Claims, 15 Drawing Sheets

U.S. PATENT DOCUMENTS

| | | | | | |
|---|---|---|---|---|---|
| 4,847,629 | A | | 7/1989 | Shimazaki | 343/901 |
| 4,849,766 | A | | 7/1989 | Inaba et al. | |
| 4,857,939 | A | | 8/1989 | Shimazaki | 343/715 |
| 4,890,114 | A | | 12/1989 | Egashira | 343/702 |
| 4,894,663 | A | | 1/1990 | Urbish et al. | 343/702 |
| 4,912,481 | A | | 3/1990 | Mace et al. | 343/700 MS |
| 4,975,711 | A | | 12/1990 | Lee | 343/702 |
| 5,030,963 | A | | 7/1991 | Tadama | 343/702 |
| 5,138,328 | A | | 8/1992 | Zibrik et al. | 343/702 |
| 5,168,472 | A | | 12/1992 | Lockwood | 367/119 |
| 5,172,084 | A | | 12/1992 | Fiedziuszko et al. | 333/704 |
| 5,200,756 | A | | 4/1993 | Feller | 343/700 MS |
| 5,214,434 | A | | 5/1993 | Hsu | 343/702 |
| 5,218,370 | A | | 6/1993 | Blaese | 343/702 |
| 5,227,804 | A | | 7/1993 | Oda | 343/702 |
| 5,227,808 | A | | 7/1993 | Davis | 343/915 |
| 5,245,350 | A | | 9/1993 | Sroka | 343/702 |
| 5,248,988 | A | | 9/1993 | Makino | 343/792 |
| 5,255,002 | A | | 10/1993 | Day | |
| 5,257,032 | A | | 10/1993 | Diamond et al. | 343/730 |
| 5,347,291 | A | | 9/1994 | Moore | 343/749 |
| 5,355,144 | A | | 10/1994 | Walton et al. | |
| 5,355,318 | A | * | 10/1994 | Dionnet et al. | 700/120 |
| 5,373,300 | A | | 12/1994 | Jenness et al. | 343/102 |
| 5,402,134 | A | | 3/1995 | Miller et al. | 343/742 |
| 5,420,599 | A | | 5/1995 | Erkocevic | 343/828 |
| 5,422,651 | A | | 6/1995 | Chang | 343/749 |
| 5,451,965 | A | | 9/1995 | Matsumoto | 343/702 |
| 5,451,968 | A | | 9/1995 | Emery | 343/749 |
| 5,453,751 | A | | 9/1995 | Tsukamoto et al. | |
| 5,457,469 | A | | 10/1995 | Diamond et al. | 343/730 |
| 5,471,224 | A | | 11/1995 | Barkeshli | 343/909 |
| 5,493,702 | A | | 2/1996 | Crowley et al. | 455/89 |
| 5,495,261 | A | | 2/1996 | Baker et al. | |
| 5,534,877 | A | | 7/1996 | Sorbello et al. | |
| 5,537,367 | A | | 7/1996 | Lockwood et al. | 367/87 |
| H001631 | H | | 2/1997 | Montgomery et al. | 342/1 |
| 5,619,205 | A | | 4/1997 | Johnson | 342/12 |
| 5,684,672 | A | | 11/1997 | Karidis et al. | 361/683 |
| 5,712,640 | A | | 1/1998 | Andou et al. | 342/70 |
| 5,767,811 | A | | 6/1998 | Mandai et al. | 343/702 |
| 5,798,688 | A | | 8/1998 | Schofield | 340/438 |
| 5,821,907 | A | | 10/1998 | Zhu et al. | 343/906 |
| 5,841,403 | A | | 11/1998 | West | 343/702 |
| 5,870,066 | A | | 2/1999 | Asakura et al. | 343/845 |
| 5,872,546 | A | | 2/1999 | Ihara et al. | 343/795 |
| 5,898,404 | A | | 4/1999 | Jou | 343/700 MS |
| 5,903,240 | A | | 5/1999 | Kawahata et al. | 343/700 MS |
| 5,926,141 | A | | 7/1999 | Lindenmeier et al. | |
| 5,943,020 | A | | 8/1999 | Liebendoerfer et al. | 343/702 |
| 5,966,098 | A | | 10/1999 | Qi et al. | 343/702 |
| 5,973,651 | A | | 10/1999 | Suesada et al. | 343/752 |
| 5,986,610 | A | | 11/1999 | Miron | 343/702 |
| 5,990,838 | A | | 11/1999 | Burns et al. | 343/702 |
| 6,002,367 | A | | 12/1999 | Engblom et al. | 343/700 MS |
| 6,028,568 | A | | 2/2000 | Asakura et al. | 343/895 |
| 6,031,499 | A | | 2/2000 | Dichter | 343/713 |
| 6,031,505 | A | | 2/2000 | Qi et al. | 343/795 |
| 6,078,294 | A | | 6/2000 | Mitarai | 343/713 |
| 6,091,365 | A | | 7/2000 | Derneryd et al. | |
| 6,097,345 | A | * | 8/2000 | Walton | 343/769 |
| 6,104,349 | A | | 8/2000 | Cohen | 343/702 |
| 6,127,977 | A | * | 10/2000 | Cohen | 343/700 MS |
| 6,131,042 | A | | 10/2000 | Lee et al. | 455/556 |
| 6,140,969 | A | | 10/2000 | Lindenmeier et al. | 343/700 MS |
| 6,140,975 | A | | 10/2000 | Cohen | 343/895 |
| 6,160,513 | A | | 12/2000 | Davidson et al. | 343/700 MS |
| 6,172,618 | B1 | | 1/2001 | Hakozaki et al. | 340/928 |
| 6,211,824 | B1 | | 4/2001 | Holden et al. | |
| 6,218,992 | B1 | | 4/2001 | Sadler et al. | 343/702 |
| 6,236,372 | B1 | | 5/2001 | Lindenmeier et al. | 373/713 |
| 6,266,023 | B1 | | 7/2001 | Nagy et al. | 343/713 |
| 6,281,846 | B1 | | 8/2001 | Puente Baliarda et al. | |
| 6,307,511 | B1 | | 10/2001 | Ying et al. | 343/702 |
| 6,329,951 | B1 | | 12/2001 | Wen et al. | 343/702 |
| 6,329,954 | B1 | | 12/2001 | Fuchs et al. | 343/775 |
| 6,367,939 | B1 | | 4/2002 | Carter et al. | 359/879 |
| 6,407,710 | B2 | | 6/2002 | Keilen et al. | 343/702 |
| 6,417,810 | B1 | | 7/2002 | Huels et al. | 343/713 |
| 6,431,712 | B1 | | 8/2002 | Turnbull | 359/604 |
| 6,445,352 | B1 | | 9/2002 | Cohen | 343/745 |
| 6,452,549 | B1 | | 9/2002 | Lo | 343/700 MS |
| 6,452,553 | B1 | | 9/2002 | Cohen | 343/702 |
| 6,476,766 | B1 | | 11/2002 | Cohen | 343/700 MS |
| 6,525,691 | B2 | * | 2/2003 | Varadan et al. | 343/700 MS |
| 6,552,690 | B2 | * | 4/2003 | Veerasamy | 343/713 |
| 2002/0000940 | A1 | | 1/2002 | Moren et al. | |
| 2002/0000942 | A1 | | 1/2002 | Duroux | |
| 2002/0036594 | A1 | | 3/2002 | Gyenes | |
| 2002/0105468 | A1 | | 8/2002 | Tessier et al. | |
| 2002/0109633 | A1 | | 8/2002 | Ow et al. | |
| 2002/0126054 | A1 | | 9/2002 | Fuerst et al. | |
| 2002/0126055 | A1 | | 9/2002 | Lindenmeier et al. | |
| 2002/0175866 | A1 | | 11/2002 | Gram | |

FOREIGN PATENT DOCUMENTS

| | | |
|---|---|---|
| EP | 0 358 090 | 3/1990 |
| EP | 0543645 | 5/1993 |
| EP | 0571124 | 11/1993 |
| EP | 0688040 | 12/1995 |
| EP | 0765001 | 3/1997 |
| EP | 0814536 | 12/1997 |
| EP | 0892459 | 1/1999 |
| EP | 0932219 | 7/1999 |
| EP | 0969375 | 1/2000 |
| EP | 0986130 | 3/2000 |
| EP | 0997974 | 5/2000 |
| EP | 1018777 | 7/2000 |
| EP | 1018779 | 7/2000 |
| EP | 1079462 | 2/2001 |
| EP | 1083624 | 3/2001 |
| EP | 1094545 | 4/2001 |
| EP | 1096602 | 5/2001 |
| EP | 1148581 | 10/2001 |
| EP | 1198027 | 4/2002 |
| EP | 1237224 | 9/2002 |
| EP | 1267438 | 12/2002 |
| ES | 2 112 163 | 3/1998 |
| ES | 2142280 | 4/2000 |
| FR | 2543744 | 10/1984 |
| FR | 2704359 | 10/1994 |
| GB | 2215136 | 9/1989 |
| GB | 2330951 | 5/1999 |
| GB | 2355116 | 4/2001 |
| JP | 55147806 | 11/1980 |
| JP | 5007109 | 1/1993 |
| JP | 5129816 | 5/1993 |
| JP | 5267916 | 10/1993 |
| JP | 5347507 | 12/1993 |
| JP | 6204908 | 7/1994 |
| WO | WO 9511530 | 4/1995 |
| WO | 9629755 | 9/1996 |
| WO | 9638881 | 12/1996 |
| WO | WO 97/06578 | 2/1997 |
| WO | 9711507 | 3/1997 |
| WO | 9732355 | 9/1997 |
| WO | 9733338 | 9/1997 |
| WO | 9735360 | 9/1997 |
| WO | 9747054 | 12/1997 |
| WO | 9812771 | 3/1998 |

| | | |
|---|---|---|
| WO | 9836469 | 8/1998 |
| WO | 9903166 | 1/1999 |
| WO | 9903167 | 1/1999 |
| WO | 9925042 | 5/1999 |
| WO | 9927608 | 6/1999 |
| WO | 9956345 | 11/1999 |
| WO | 0001028 | 1/2000 |
| WO | 0003453 | 1/2000 |
| WO | 0022695 | 4/2000 |
| WO | 0049680 | 8/2000 |
| WO | 0052784 | 9/2000 |
| WO | 0052787 | 9/2000 |
| WO | 0103238 | 1/2001 |
| WO | 0108257 | 2/2001 |
| WO | 0113464 | 2/2001 |
| WO | 0117064 | 3/2001 |
| WO | 0124314 | 4/2001 |
| WO | 0126182 | 4/2001 |
| WO | 0128035 | 4/2001 |
| WO | 0131739 | 5/2001 |
| WO | 0133665 | 5/2001 |
| WO | 0135491 | 5/2001 |
| WO | 0137369 | 5/2001 |
| WO | 0137370 | 5/2001 |
| WO | 0141252 | 6/2001 |
| WO | 0148861 | 7/2001 |
| WO | 0154225 | 7/2001 |
| WO | 0173890 | 10/2001 |
| WO | 0178192 | 10/2001 |
| WO | 0182410 | 11/2001 |
| WO | 0235646 | 5/2002 |
| WO | 02091518 | 11/2002 |
| WO | 02096166 | 11/2002 |

OTHER PUBLICATIONS

Jaggard, Dwight L., "Fractal Electrodynamics and Modeling," Directions in Electromagnetic Wave Modeling, pp. 435–446 (1991).

Hohlfeld, Robert G. et al., "Self–Similarity and the Geometric Requirements for Frequency Independence in Antennae," Fractals, vol. 7, No. 1, pp. 79–84 (1999).

Samavati, Hirad, et al., "Fractal Capacitors," IEEE Journal of Solid–State Circuits, vol. 33, No. 12, pp. 2035–2041 (Dec. 1998).

Pribetich, P., et al., "Quasifractal Planar Microstrip Resonators for Microwave Circuits," Microwave and Optical Technology Letters, vol. 21, No. 6, pp. 433–436 (Jun. 20, 1999).

Zhang, Dawei, et al., "Narrowband Lumped–Element Microstrip Filters Using Capacitively–Loaded Inductors," IEEE MTT–S Microwave Symposium Digest, pp. 379–382 (May 16, 1995).

Gough, C.E., et al., "High Tc coplanar resonators for microwave applications and scientific studies," Physica C, NL,North–Holland Publishing, Amsterdam, vol. 282–287, No. 2001, pp. 395–398 (Aug. 1, 1997).

Radio Engineering Reference—Book by H. Meinke and F.V. Gundlah, vol. I, Radio components. Circuits with lump parameters. Transmission lines. Wave–guides. Resonators, Arrays, Radio waves propagation, States Energy Publishing House, Moscow, with English translation (1961) [4 pp.].

V.A. Volgov, "Parts and Units of Radio Electronic Equipment (Design & Computation)," Energiya, Moscow, with English translation (1967) [4 pp.].

Puente, C., et al., "Multiband properties of a fractal tree antenna generated by electrochemical deposition," Electronics Letters, IEE Stevenage, GB, vol. 32, No. 25, pp. 2298–2299 (Dec. 5, 1996).

Puente, C., et al., "Small but long Koch fractal monopole," Electronics Letters, IEE Stevenage, GB, vol. 34, No. 1, pp. 9–10 (Jan. 8, 1998).

Puente Baliarda, Carles, et al., "The Koch Monopole: A Small Fractal Antenna," IEEE Transactions on Antennas and Propagation, New York, US, vol. 48, No. 11, pp. 1773–1781 (Nov. 1, 2000).

Cohen, Nathan, "Fractal Antenna Applications in Wireless Telecommunications," Electronics Industries Forum of New England, 1997. Professional Program Proceedings Boston, MA US, May 6–8, 1997, New York, NY US, IEEE, US pp. 43–49 (May 6, 1997).

Anguera, J. et al. "Miniature Wideband Stacked Microstrip Patch Antenna Based on the Sierpinski Fractal Geometry," IEEE Antennas and Propagation Society International Symposium, 2000 Digest. Aps., vol. 3 of 4, pp. 1700–1703 (Jul. 16, 2000).

Hara Prasad, R.V., et al., "Microstrip Fractal Patch Antenna for Multi–Band Communication," Electronics Letters, IEE Stevenage, GB, vol. 36, No. 14, pp. 1179–1180 (Jul. 6, 2000).

Borja, C. et al., "High Directivity Fractal Boundary Microstrip Patch Antenna," Elctronics Letters. IEE Stevenage, GB, vol. 36, No. 9, pp. 778–779 (Apr. 27, 2000).

Ali, M. et al., "A Triple–Band Internal Antenna for Mobile Hand–held Terminals," IEEE, pps. 32–35 (1992).

Romeu, Jordi et al., "A Three Dimensional Hilbert Antenna," IEEE, pps. 550–553 (2002).

Parker et al., "Microwaves, Antennas & Propagation," IEEE Proceedings H, pps. 19–22 (Feb. 1991).

* cited by examiner

ADVANCED MULTILEVEL ANTENNA FOR MOTOR VEHICLES

This application is a continuation of international application number PCT ES00/00148, filed Apr. 19, 2000.

OBJECT OF THE INVENTION

This invention relates a multiservice advanced antenna, formed by a set of polygonal elements, supported by a transparent conductive layer coated on the transparent window of a motor vehicle.

The particular shape and design of the polygonal elements, preferably triangular or square, enhances the behavior of the antenna to operate simultaneously at several bands.

The multiservice antenna will be connected to most of the principal equipments presents in a motor vehicle such as radio (AM/FM), Digital Audio and Video Broadcasting (DAB and DVB), Tire pressure control, Wireless car aperture, Terrestrial Trunked Radio (TETRA), mobile telephony (GSM 900-GSM 1800-UMTS), Global Positioning System (GPS), Bluetooth and wireless LAN Access.

BACKGROUND OF THE INVENTION

Until recently, telecommunication systems present in an automobile were limited to a few systems, mainly the analogical radio reception (AM/FM bands). The most common solution for these systems is the typical whip antenna mounted on the car roof. The current tendency in the automotive sector is to reduce the aesthetic and aerodynamic impact due to these antennas by embedding them in the vehicle structure. Also, a major integration of the several telecommunication services into a single antenna would help to reduce the manufacturing costs or the damages due to vandalism and car wash equipments.

The antenna integration is becoming more and more necessary as we are assisting to a profound change in telecommunications habits. The internet has evoked an information age in which people around the globe expect, demand, and receive information. Car drivers expect to be able to drive safely while handling e-mail an telephone calls and obtaining directions, schedules, and other information accessible on the WWW.

Telematic devices can be used to automatically notify authorities of an accident and guide rescuers to the car, track stolen vehicles, provide navigation assistance to drivers, call emergency roadside assistance and remote diagnostics of engine functions.

High equipments and services have been available on some cars for very few years. High equipment and service costs initially limited them to luxury cars. However, rapid declines in both equipment and service prices are bringing telematic products into mid-priced automobiles. The massive introduction of new systems will generate a proliferation of new car antennas, in contradiction with the aesthetic and aerodynamic requirements of integrated antennas.

Antennas are essentially narrowband devices. Their behavior is highly dependent on the antenna size to the operating wavelength ratio. The use of fractal-shaped multiband antennas was first proposed in 1995 (U.S. Pat. No. 9,501,019). The main advantages addressed by these antennas were a multifrequency behavior, that is the antennas featured similar parameters (input impedance, radiation pattern) at several bands maintaining their performance, compared with conventional antennas. Also, fractal-shapes permit to obtain antenna of reduced dimensions compared to other conventional antenna designs, as well.

In 1999, multilevel antennas (PCT/ES/00296) resolved some practical problems encountered with the practical applications of fractal antennas. Fractal auto-similar objects are, in a strict mathematic sense, composed by an infinite number of scaled iterations, impossible to achieve in practice. Also, for practical applications, the scale factor between each iteration, and the spacing between the bands do not have to correspond to the same number. Multilevel antennas introduced a higher flexibility to design multiservice antennas for real applications, extending the theoretical capabilities of ideal fractal antennas to practical, commercial antennas Several solutions were proposed to integrate the AM/FM antenna in the vehicle structure. A possible configuration is to use the thermal grid of the rear windshield (Patent N° WO95/11530). However, this configuration requires an expensive electronic adaptation network, including RF amplifiers and filters to discriminate the radio signals from the DC source. Moreover, to reduce costs, the AM band antenna often comes apart from the heating grid limiting the area of the heating grid.

Other configuration is based on the utilization of a transparent conductive layer. This layer is coated on the vehicle windshield is introduced to avoid an excessive heating of the vehicle interior by reflecting IR radiations.

The utilization of this layer as reception antenna for AM or FM band has been already proposed with several antenna shapes. Japanese Patent JP-UM-49-1562 is often cited as one of the first to propose the utilization of transparent conductive layer as reception antenna. U.S. Pat. No. 445,884 proposed to use the entire windshield conductive layer as impedance matching for FM band substantially horizontal antenna element. Others configurations proposed to leave a slot aperture between the windshield screen border and the conductive transparent layer (U.S. Pat. No. 5,355,144) or to impress odd multiple half wavelengths monopoles onto the crystal (U.S. Pat. No. 5,255,002).

Obliviously all these antenna configurations can only operate at a determinate frequency band in reason of the frequency dependence of the antenna parameter and are not suitable for a multiservice operation. One of the main substantial innovations introduced by the present invention consists in using a single antenna element, maintaining the same behavior for several applications, and to keep the IR protection. The advantages reside in a full antenna integration with no aesthetic or aerodynamic impact, a full protection from vandalism, and a manufacturing cost reduction.

SUMMARY OF THE INVENTION

The present invention relates an antenna for a motor vehicle with the following parts and features a) a transparent window coated with an optically transparent conducting layer on at least one side of any of the window material layers b) a multilevel structure impressed on this conducting layer. This multilevel structure is composed by a set of polygonal elements of the same class, preferably triangles or squares.

c) a two-conductor feeding transmission line d) a similar impedance at the feeding point and a similar horizontal radiation pattern in at least three frequencies within three bands, wherein two of said three frequencies are selected from the following: FM, DAB, Tire pressure control, Wireless car aperture, Tetra, DVB, GSM900/AMPS, GSM1800/DCS/PCS/DECT, UMTS, GPS, Bluetooth and WLAN.

The typical frequency bands of the different applications are the following:

FM (80 MHz~110 MHz)

DAB (205 MHz~230 MHz)

Tetra (350 MHz~450 MHz)

Wireless Car Aperture (433 MHz, 868 MHz)

Tire pressure Control (433 MHz)

DVB (470 MHz~862 MHz)

GSM900/AMPS (820 MHz~970 MHz)

GSM1800/DCS/PCS/DECT (1700 MHz~1950 MHz)

UMTS (1920 MHz~2200 MHz)

Bluetooth (2400 MHz~2500 MHz)

WLAN (4.5 GHz~6 GHz)

The main advantage of the invention is the multiband and multiservice behavior of the antenna. This permits a convenient and easy connection to a single antenna for the majority of communication systems of the vehicle.

This multiband behavior is obtained by a multilevel structure composed by a set of polygonal elements of the same class (the same number of sides), electromagnetically coupled either by means of an ohmic contact or a capacitive or inductive coupling mechanism. The structure can be composed by whatever class of polygonal elements. However, a preference is given to triangles or squares elements, being these structures more efficient to obtain a omnidirectional pattern in the horizontal plane. To assure an easy identification of each element composing the entire structure and the proper multiband behavior, the contact region between each of said elements has to be, in at least the 75% of the elements, always shorter than a 50% of the perimeters of said polygonal structures.

The other main advantage of the invention resides in the utilization of a transparent conductive layer as support for this antenna. Being transparent, this antenna can be coated in the windshield screen of a motor vehicle. Other possible positions are the side windows or the rear windows.

This optically transparent and conducting layer is habitually used in vehicle windshield screen to reflect the major part of IR radiations. The most common material used is ITO (indium tin oxide), although other materials may be used (like for instance $TiO_2$, SnO or ZnO), by sputtering vacuum deposition process. An additional passive layer can be added to protect the said conducting layer from external aggression. Materials for this passivation layer are made, for instance, of $SiO_2$, or any other material used for passivation obtained by vacuum deposition, or also a polymeric (resin) coating sprayed on the structure. During the sputtering process, a mask can be placed on the substrate material to obtain the desired multiband antenna shape. This mask normally is made of conducting special stainless steel or copper for this purposes, or a photosensitive conducting material to create the mask by photochemical processes This transparent conductive layer may be also connected to an heating source to defrost the window in presence of humidity or ice.

Other advantage of the multiband antenna is to reduce the total weight of the antenna comparing with classical whip. Together with the costs, the component weight reduction is one of the major priority in the automotive sector. The cost and weight reductions are also improved by the utilization of only single cable to feed the multiservice antenna.

This transparent conductive layer could be also deposited on support different than a transparent windshield or other vehicle windows. An adequate position could the vehicle roof to assure an optimum reception from satellite signals for instance.

BRIEF DESCRIPTION OF THE DRAWINGS

FIG. 2: a triangular multilevel structure (10) fed as a monopole and with the transparent conducting layer (4) filling the inside area of the polygonal elements and wherein the rest of the window surface (11) is not coated with said conducting layer.

FIG. 3: a triangular multilevel structure (10) fed as a monopole and wherein the transparent conducting layer (4) only defines the perimeter of the polygonal elements of the characteristic multilevel structure, and wherein the rest of the window surface (11) is not coated with said conducting layer.

FIG. 4: a triangular multilevel structure (10) fed as an aperture antenna, and wherein the transparent conducting layer (4) covers most of the transparent window support (11) except the solid multilevel structure except the inner area of the several polygons composing said multilevel structure.

FIG. 5: a slot triangular multilevel structure (10) defined by the perimeter of the polygonal elements, fed as an aperture antenna, wherein the transparent conducting layer (4) covers most of the transparent window (11) support except a slotted multilevel structure.

FIG. 6: a triangular multilevel structure (10), wherein a first solid multilevel structure, connected to the feeding line, is impressed on the surface of a first transparent support (4) and a second complementary multilevel structure is impressed on a second parallel surface of the transparent support of the window (11), such as the set of the two structures effectively block the incoming IR radiations from outside of the vehicle.

FIG. 7: An example of how several multilevel structures (10) can be printed at the same time using the same procedure and scheme described in any of the preceding configurations (FIGS. 2 to 6) or a combination of them, to form either an antenna array or an space diversity or polarization diversity scheme.

For the sake of clarity but without a limiting purpose, FIGS. 8 to 14 describe other possible examples of multilevel structures (10) in several configuration that can be used following the scope and spirit of the present invention. As it is readily seen by those skilled in the art, the essence of the invention lays on the combination of the multilevel structure which yields a multiband behavior, with the effectively invisible setting of said structure on a vehicle window, and that several combinations of polygonal elements can be used following the same essential scheme as those described in the present document.

Figure 8:
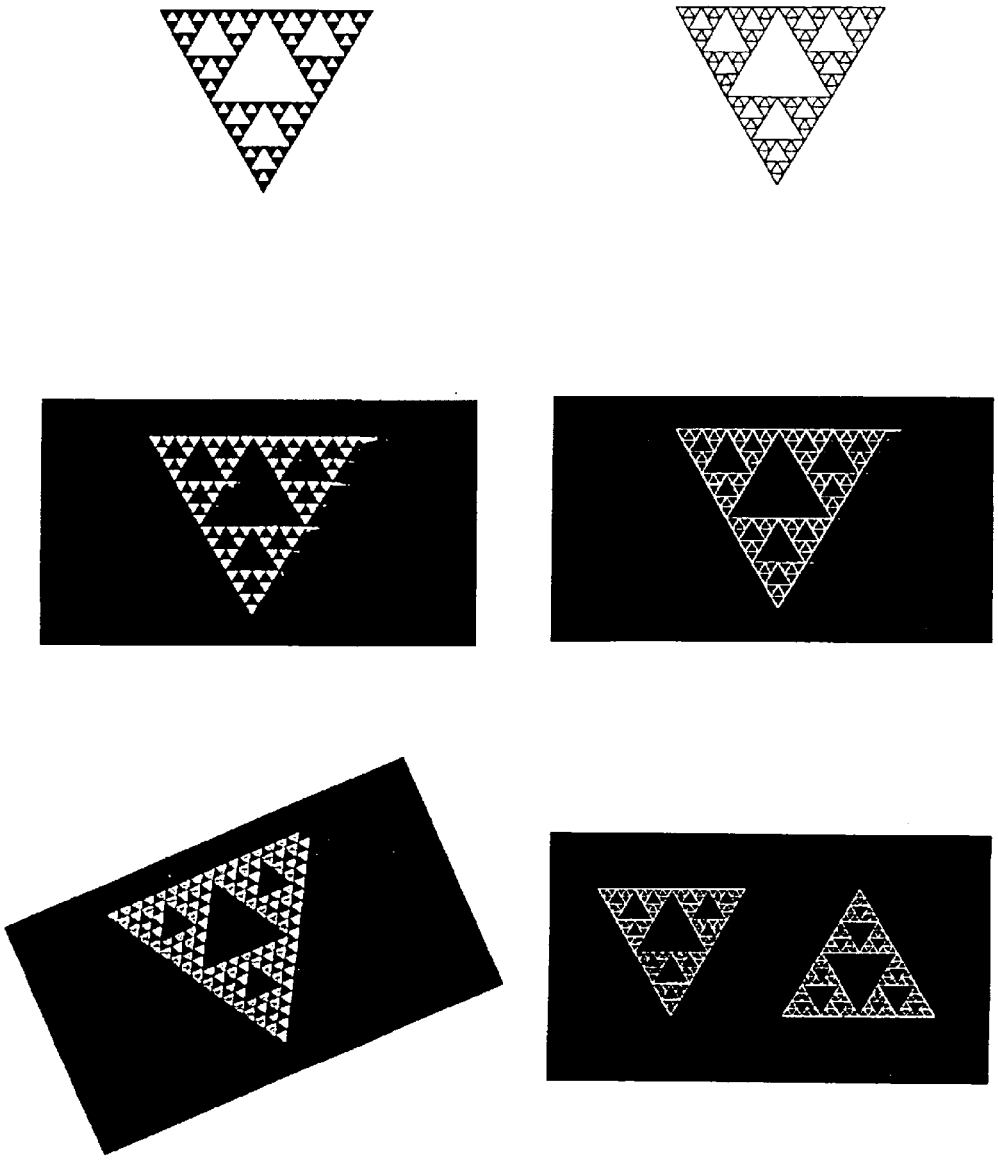

FIG. 8: Another example of a triangular multilevel structure (10), said multilevel structure approximating an ideal Sierpinski triangle, presented in the configurations described in FIGS. 2 to 7.

Figure 9:
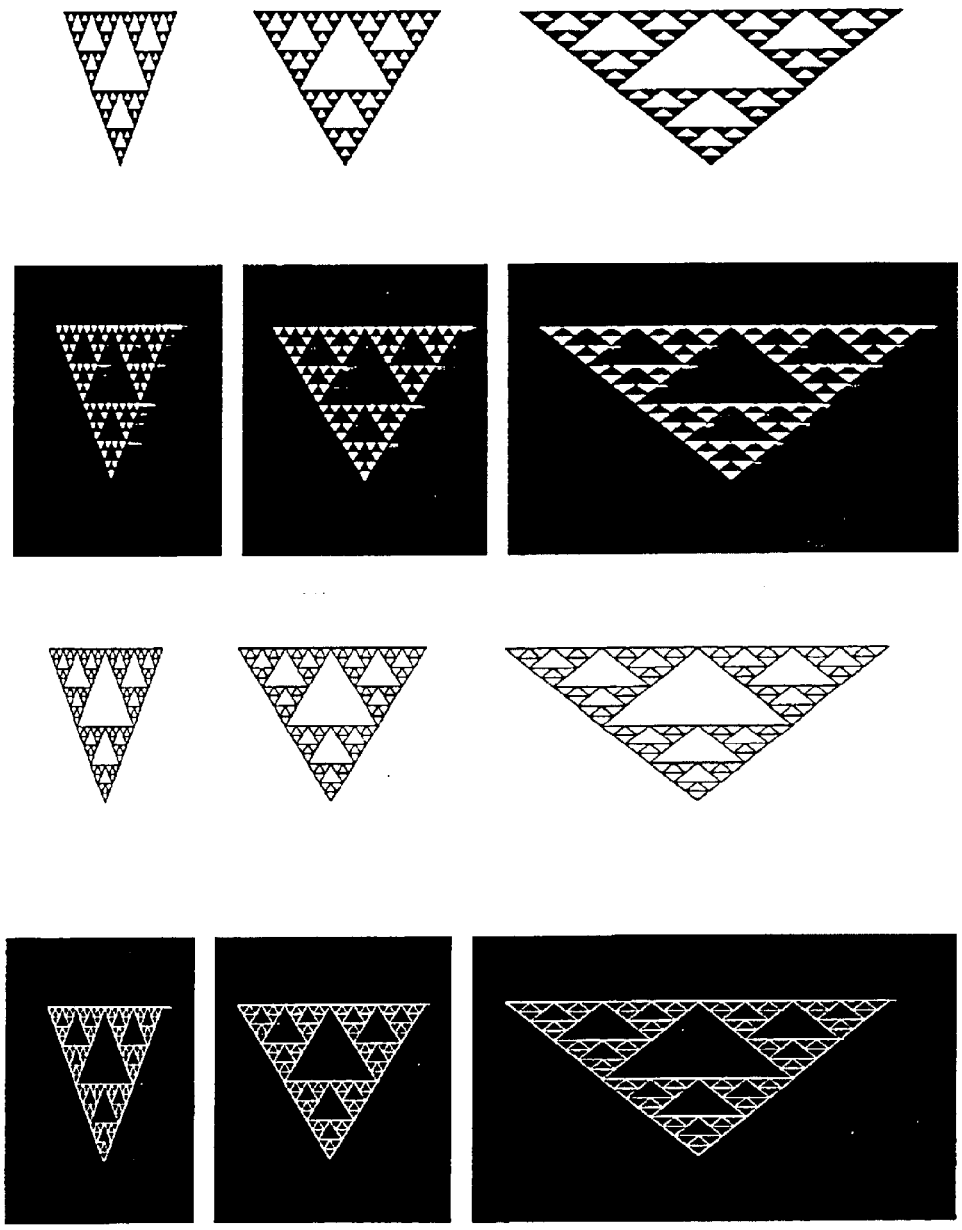

FIG. 9: A triangular multilevel structure (10), approximating a Sierpinski triangle and where the lower vertex angle is changed to match the antenna to different characteristic impedances of the feeding two conductor transmission line such as for instance 300 Ohms (for example for a twin-wire transmission line), a 50 Ohms or a 75 Ohms transmission line.

Figure 10:
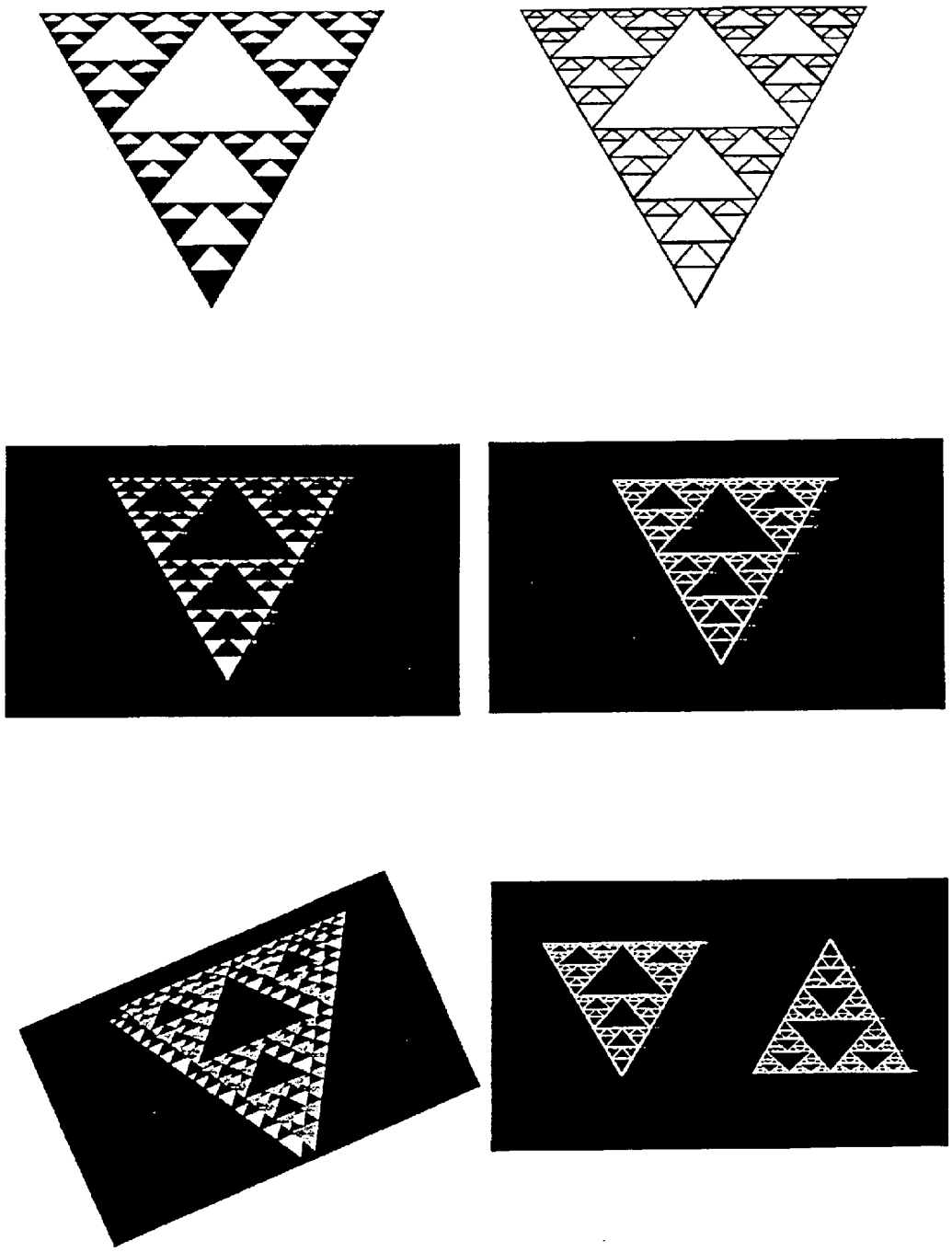

FIG. 10: A triangular multilevel structure (10), approximating a Sierpinski triangle and wherein although the polygons are all of the same class (triangles), they do not keep the same size, scale or aspect ratio to tune the resonant frequencies to the several operating bands.

Figure 11:
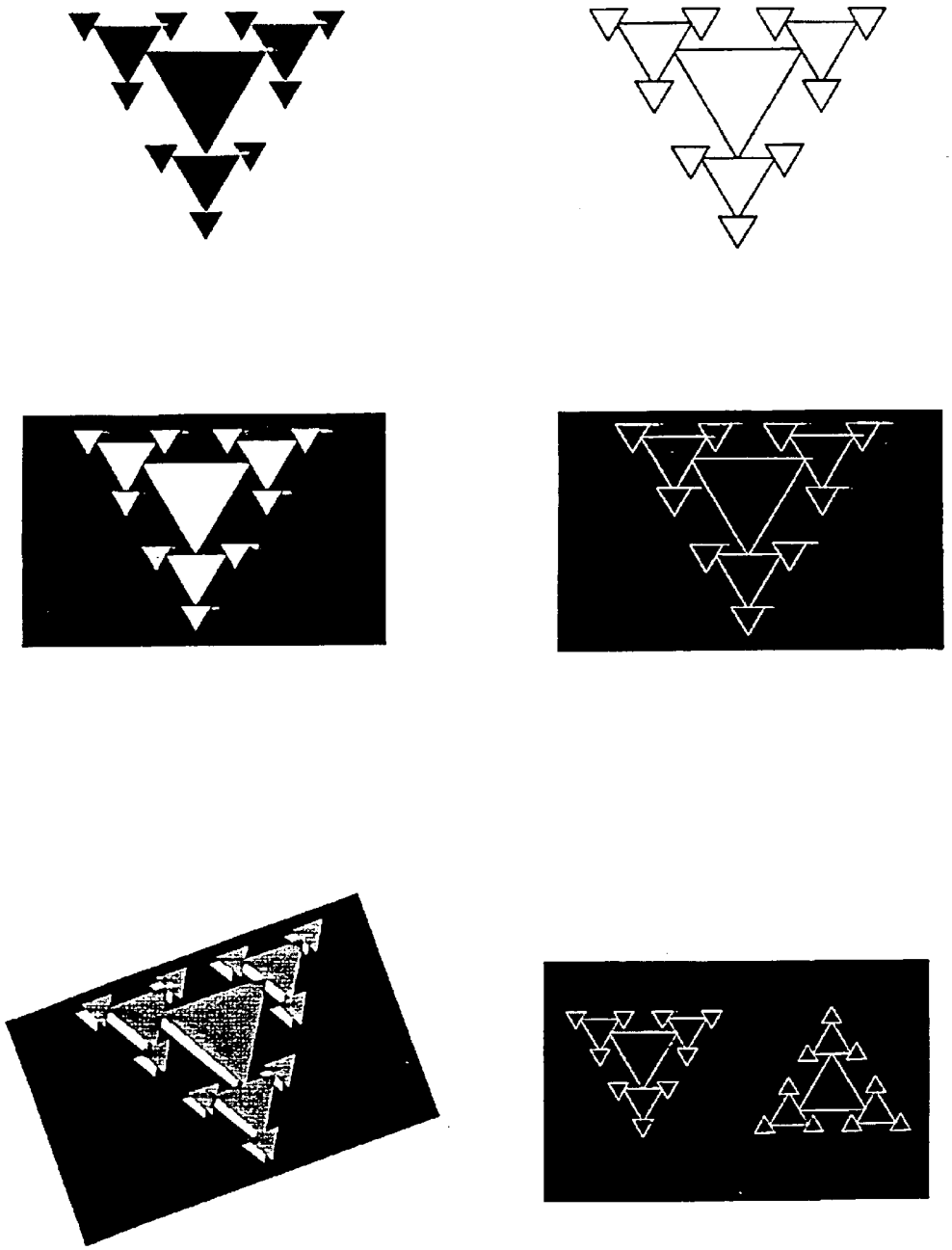

FIG. 11: Another example of multiservice antenna configurations where the basic polygon of the multilevel structure is a triangle.

Figure 12:
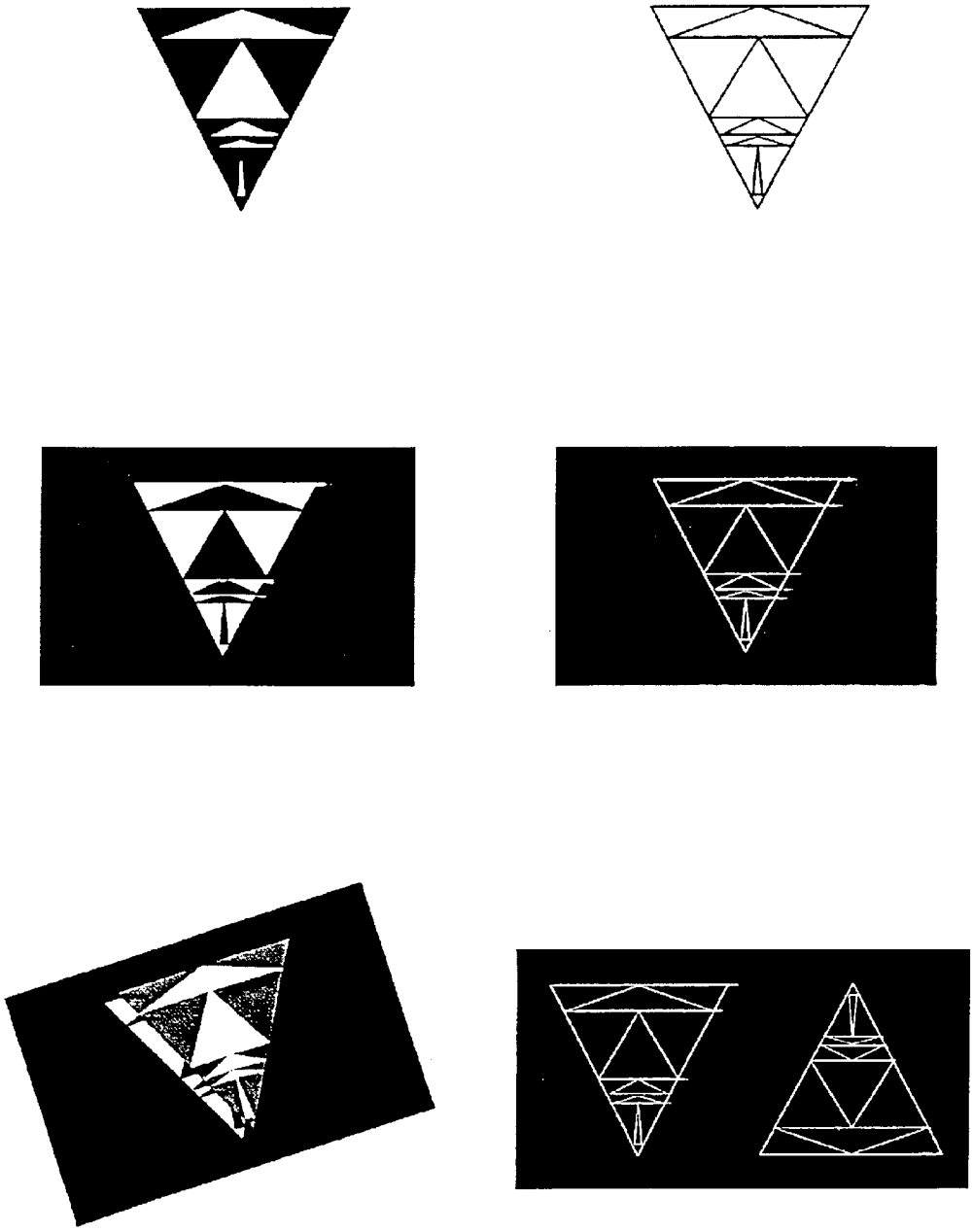

FIG. 12: Another example of multiservice antenna configurations where the basic polygon of the multilevel structure is a triangle.

Figure 13:
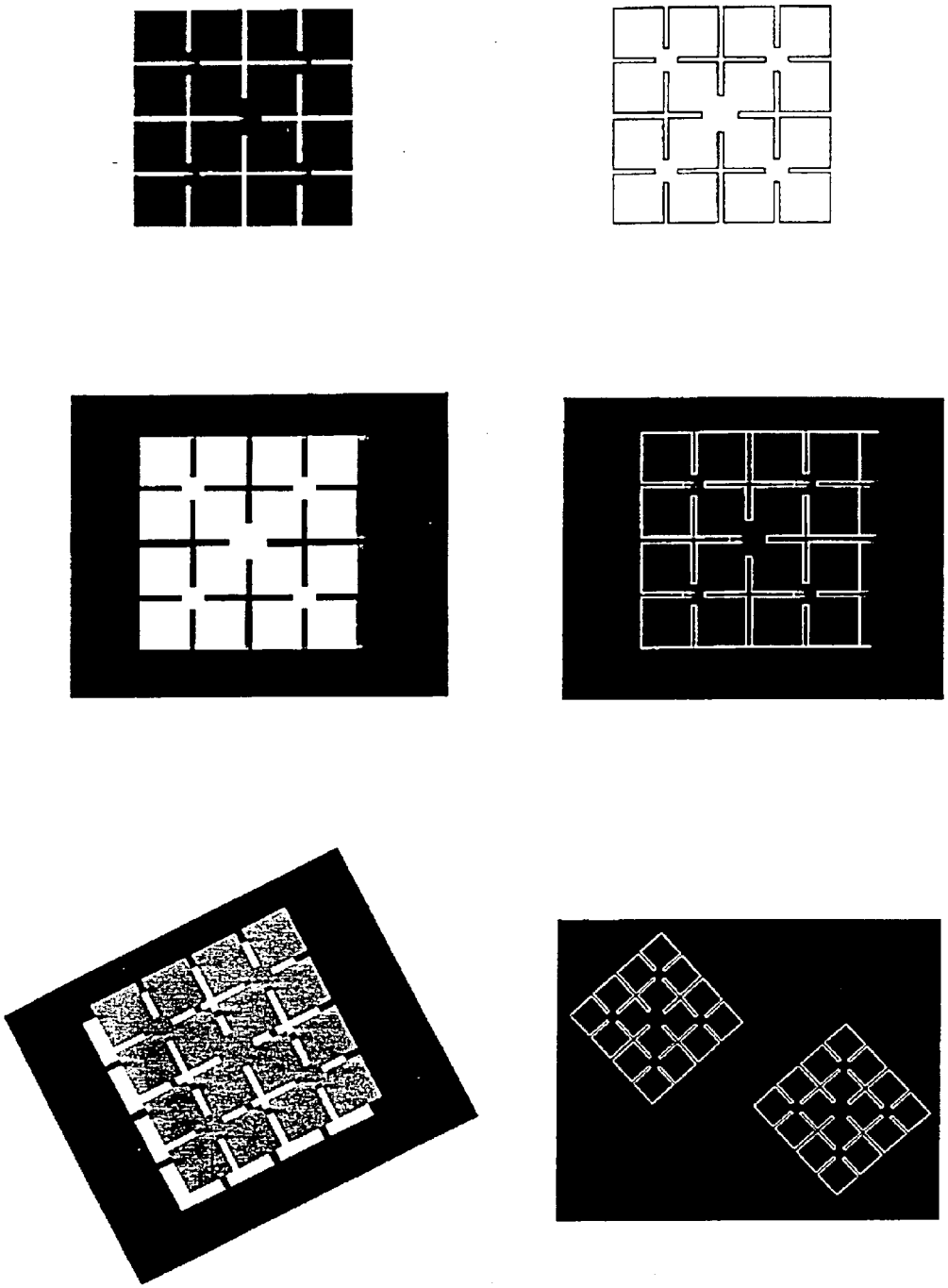

FIG. 13: Another example of multiservice antenna configurations where the basic polygon of the multilevel structure is a square.

Figure 14:
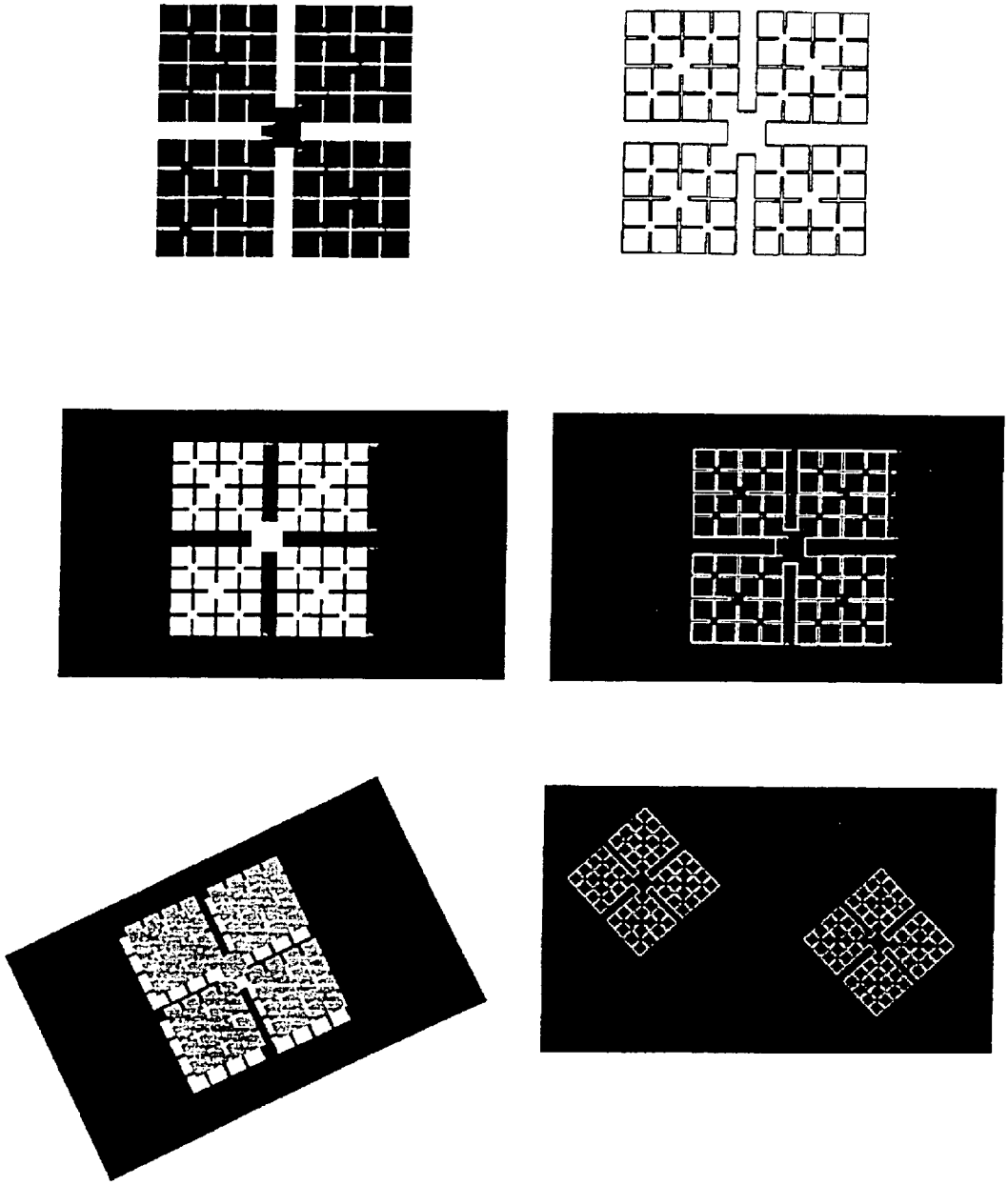

FIG. 14: Another example of multiservice antenna configurations where the basic polygon of the multilevel structure is a square.

Figure 15:
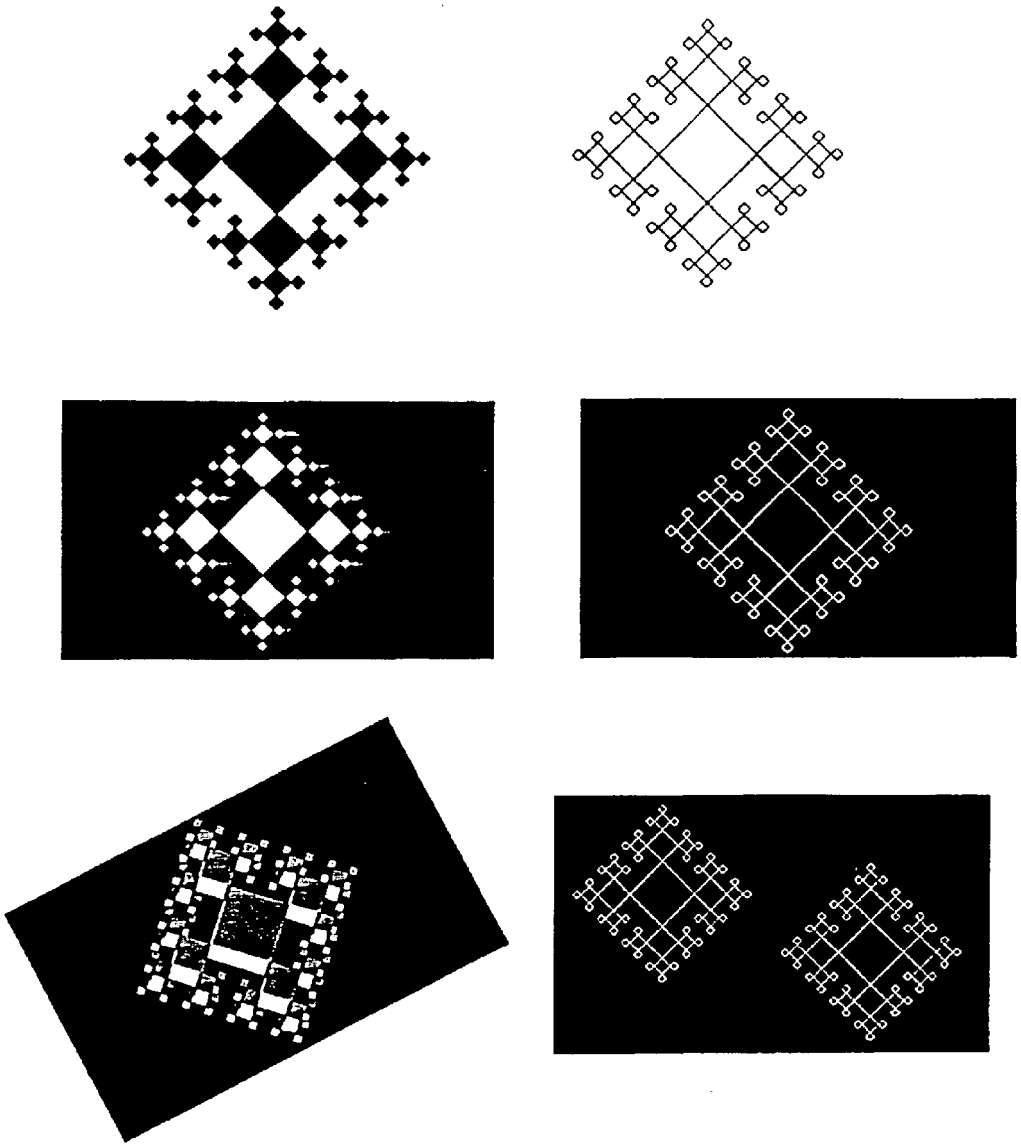

FIG. 15: Another example of multiservice antenna configurations where the basic polygon of the multilevel structure is a square.

DETAILED DESCRIPTION OF THE PREFERRED EMBODIMENTS

The present invention describes a multiservice antenna including at least a multilevel structure (10). A multilevel structure is composed by a set of polygonal elements, all of them of the same class (the same number of sides like), wherein said polygonal elements are electromagnetically coupled either by means of an ohmic contact or a capacitive or inductive coupling mechanism. Said multilevel structure can be composed by whatever class of polygonal elements (triangle, square, pentagon, hexagon or even a circle or an ellipse in the limit case of infinite number of sides) as long as they are of the same class. However, a preference is given to triangles or squares elements, being these structures more efficient to obtain an omnidirectional pattern in the horizontal plane or an orthogonal polarization diversity from the same antenna. A multilevel structure differs from a conventional shape mainly by the interconnexion and coupling of the different elements, which yields a particular geometry where most of the several elements composing the structure can be individually detected by a simple visual inspection. To assure an easy identification of each element composing the entire structure, the contact region between each element has to be, in at least the 75% of the elements, always shorter than a 50% of the perimeters of said polygonal structures. The multilevel structure is easily identifiable and distinguished from a conventional structure by identifying the majority of elements which constitute it.

In the physical construction of a multilevel antenna, the multilevel structure can be optionally defined by the external perimeter of its polygonal elements alone. The behavior of such antenna is not very different from that composed with solid polygonal elements as long as said elements are small compared with the shortest operating wavelength, since the interconnexion between the elements usually forces the current distribution to follow the external perimeter of said polygonal elements. A wire multilevel structure could be impressed on a transparent open window and could be used as heating defrosting structure.

Figure 1:
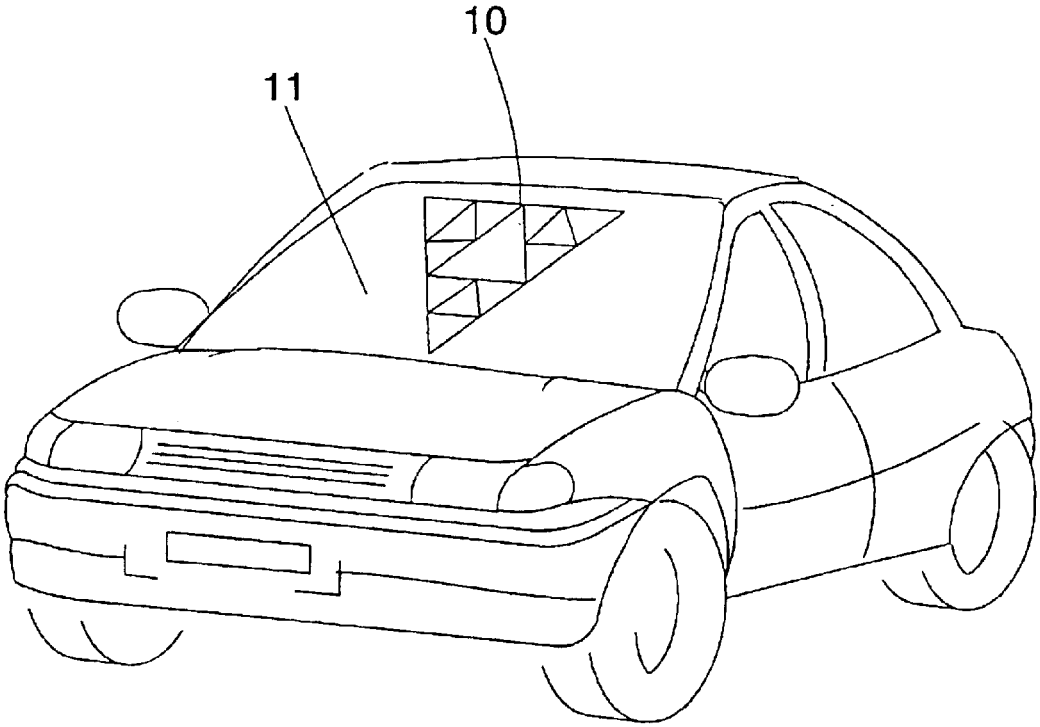
FIG. 1 describes a general example of the antenna position impressed on the windshield screen. The antenna structure is based on multilevel structure with triangular elements in this particular example, but other polygonal structures can be used as well.
Figure 2:
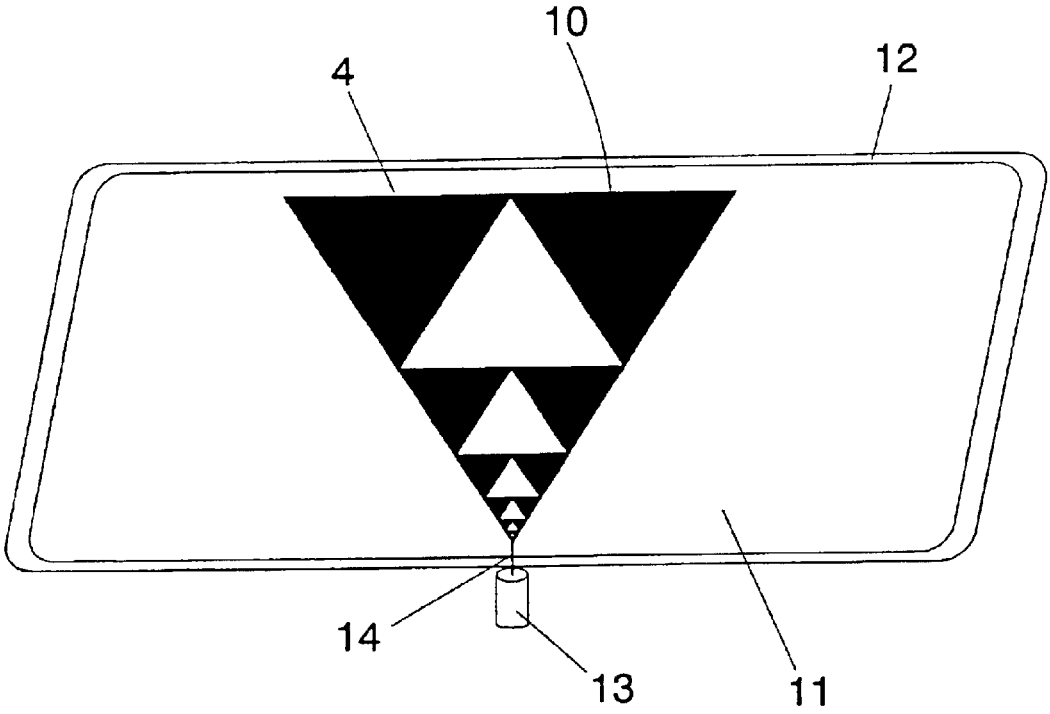
FIGS. 2 to 7 describe possible configurations for the multilevel antenna which support is an optically transparent conductive layer. These configurations are.

FIG. 2 describes a preferred embodiment of a multiservice antenna (solid embodiment). This configuration is composed by a set of triangular elements (10), scaled by a factor of ½. Seven triangle scales are used and the antenna features a similar behavior at seven different frequency bands, each one being approximately twice higher than the previous one. The lower frequency is related to the outer triangle-like perimeter dimensions, approximately a quarter-wavelength at the edge of the triangle. This configuration is fed with a two conductor structure such as a coaxial cable (13), with one of the conductors connected to the lower vertex of the multilevel structure and the other conductor connected to the metallic structure of the car. The contact can be made directly or using an inductive or capacitive coupling mechanism to match the antenna input impedance. In this particular configuration, the triangular elements are impressed on an optically transparent conductive layer supported by a transparent substrate like the windshield screen (11) or window of a motor vehicle. The ground plane is partially realized by the hood of the vehicle. Windshield screen, or any vehicle windows in general is an adequate position to place this antenna element. Using the windshield screen, offering a wide open area, the rest of the car body will have a reduced effect on the radiation pattern, making this antenna useful for the wide range of telecommunications for motor vehicles, where a fairly omnidirectional pattern is required. The polarization of this antenna is lineal vertical in the plane orthogonal to the window plane and containing the symmetry axis of structure. At other azimuthally angles the antenna polarization is tilted, which is useful for detecting the incoming signals that in a typically multipath propagation environment feature a mostly unpredictable polarization state.

Figure 3:
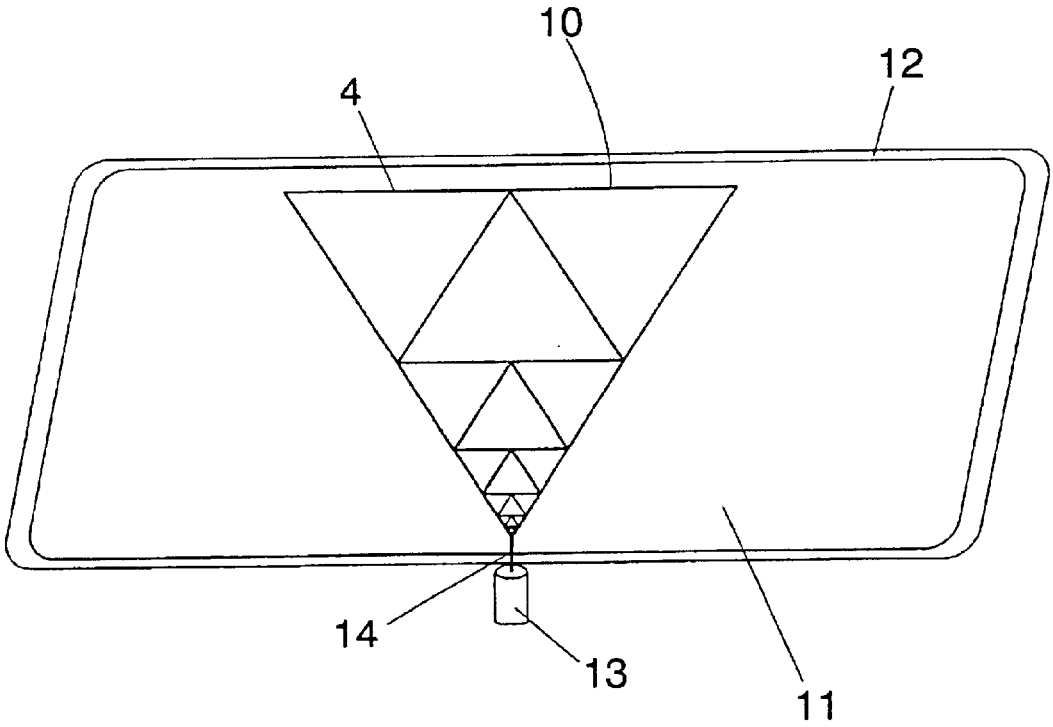

Another preferred embodiment is presented in FIG. 3 (grid or wire embodiment). This configuration is similar to the previous one, where the antenna is fed form the lower vertex like a quarter-wavelength monopole. In this multilevel antenna, the triangular elements are only defined by their external perimeter. Its behavior is similar to the previous model since, in FIG. 2 configuration, the current distribution is mainly concentrated in the external perimeter of the triangular elements due to the reduced ohmic contact between themselves. This configuration requires less material to be deposited on the transparent support.

Figure 4:
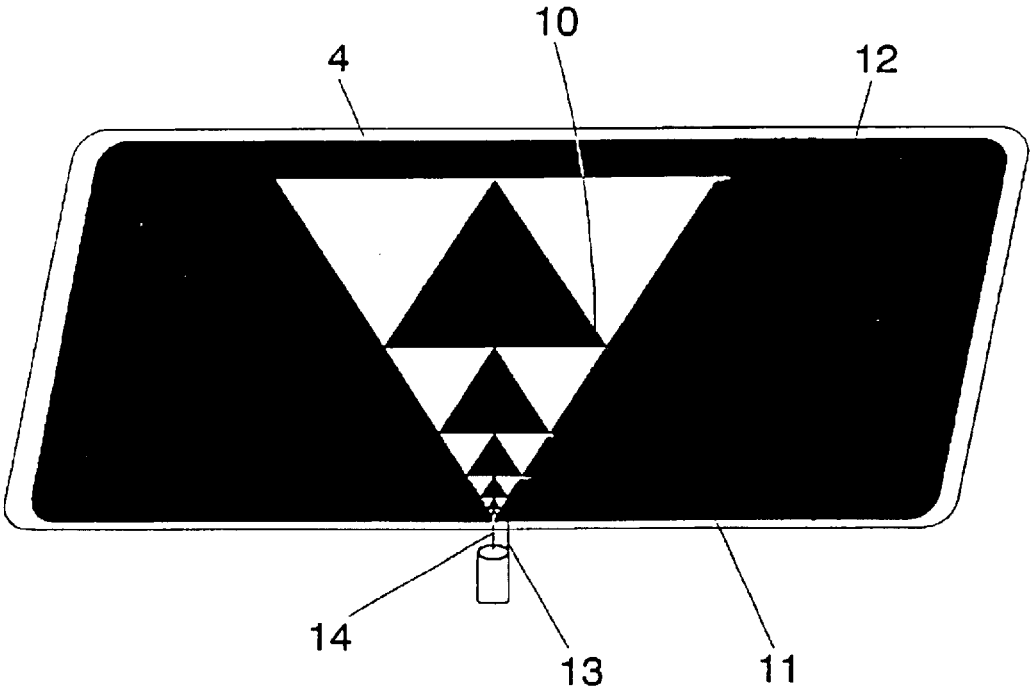

The embodiment in FIG. 4 (aperture embodiment) configuration offers an additional advantage to the multiservice antenna. In this case, the whole transparent substrate is coated with a transparent conductive layer like a car windshield (11) for instance. This conductive layer, usually composed by a material such as (Indium Tin Oxide) ITO reduces the effect of heating IR radiations. The multilevel antenna is defined by triangular elements where the conductive layer has been cut-off. This antenna configuration corresponds to a multilevel aperture antenna. This shape is constructed for instance by interposing an adequate mask during the sputtering process of the transparent conducting layer. The feeding scheme can be one of the techniques usually used in conventional aperture antenna. In the described figure, the inner coaxial cable (13) is directly connected to the lower triangular element and the outer connector to the rest of the conductive layer, which can be optionally connected to the metallic body of the car. Other feeding configurations are possible, using a capacitive coupling for instance. This configuration combines the advantages of a multiservice antenna together with a IR protection.

Figure 5:
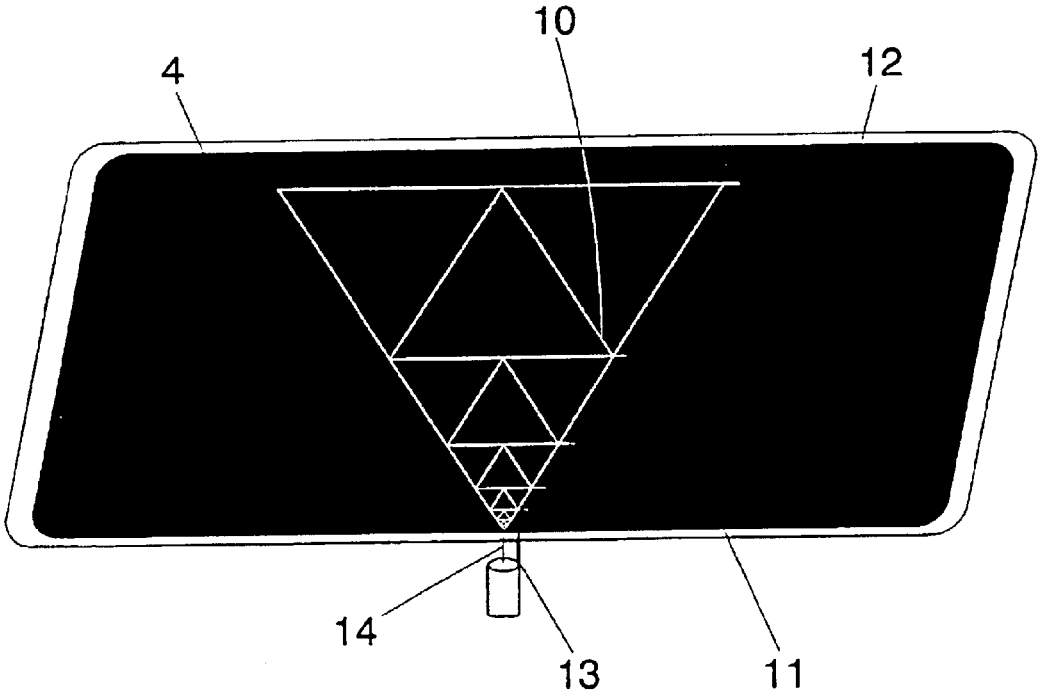

The in-vehicle IR protection can be improved with the antenna configuration presented in FIG. 5 (slot embodiment). The antenna remains similar to the previous one, in a configuration of an aperture antenna. In this case, the multilevel antenna is defined only the external perimeter of the triangular element where the conductive layer has been cut-off. Such a configuration where an arbitrary antenna geometry is slotted on a metallic surface is commonly know as a slot-antenna as well. The feeding mechanism proposed in this embodiment connects the inner coaxial cable (13) directly to the lower triangular element and the outer connector to the rest of the conductive layer, which can be optionally connected to the metallic body of the car.

Figure 6:
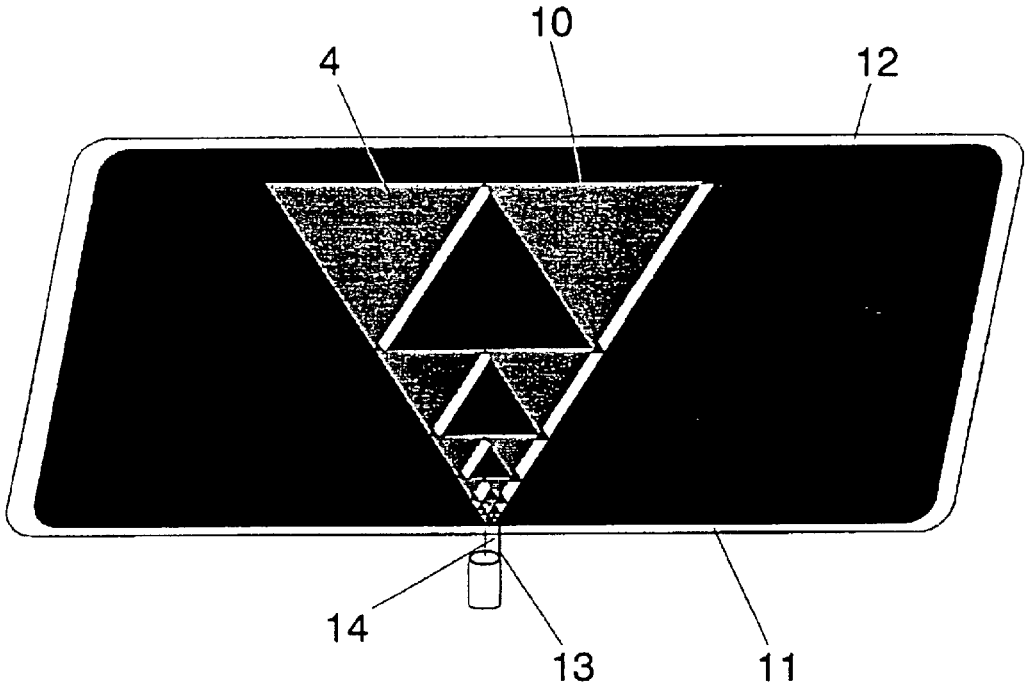
Figure 7:
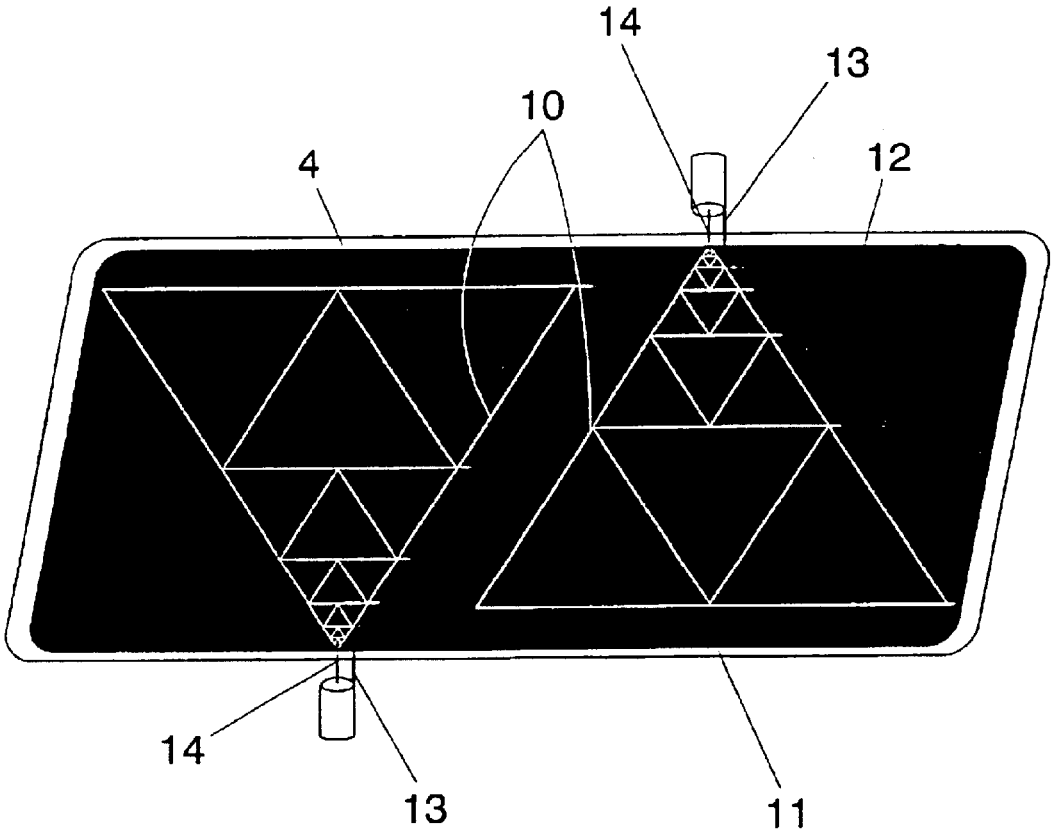

The embodiment presented in FIG. 6 (combined embodiment) offers the maximum protection from IR radiations. In this case, two conductive transparent layers are used to support the coated multiservice transparent antenna. A multiservice antenna corresponding to the configuration of FIG. 4 is fabricated on the first layer. Whatever other configuration presented previously could be also used. The second parallel surface of the transparent support of the window is coated with the complementary structure of the first multilevel structure, in such a way that the uncoated shape in the first surface becomes coated in second surface, an the coated shape in the first surface becomes uncoated in the parallel second surface. The inner coaxial cable (13) is directly connected to the lower triangular element of the first layer and the outer connector to the second parallel conductive layer. This embodiment is useful to block the infrared radiation coming from outside of the vehicle.

Based on whatever of the antenna configuration proposed in FIGS. 2 to 6, the reception system can be easily improved using space-diversity or polarization diversity techniques. In reason of multiple propagation paths, destructive interferences may cancel the signal in the reception antenna. This will be particularly true in a high density urban area. Two or several multiservice antennas, using a configuration as described in the previous model are presented in FIG. 7. The advantage of using the techniques described in the present invention is that printing several antennas in the same transparent window support do not affect much the cost of the final solution with respect to that of a single multiservice antenna, such that the diversity scheme can be included at a low cost.

From FIGS. 8 to 12, other preferred embodiments of multiservice antennas defined by triangular elements are presented. The feeding scheme and the construction process for this additional embodiments are the same as those previously described. As it can be seen by those skilled in the art, other configurations of multilevel antennas can be used as well within the same scope and spirit of the present invention, which relies on combining the multiband feature of a multilevel antenna structure with the transparent conducting support of a vehicle window to obtain an advantageous multiservice operation with virtually no aesthetic and aerodynamic impact on the car. In each figure, the antenna is represented in each of the different configurations described previously (solid, grid, aperture, slot or combined configuration). The antenna presented in FIG. 8 approximates the shape of a Sierpinski triangle. Since five scale levels are included in this example, this configuration assures a similar antenna behavior at five frequency bands. The band spacing will be approximately an octave due to the reduction scale factor of two present between the several sub-structures of the antenna. The lower triangular vertex of the antenna can be different from 60° and can be decreased or increased to match the antenna input impedance to the feeding line.

Different antenna configurations with a modified triangle angle are presented in FIG. 9. The three examples presented do not suppose a limitation in the choice of the triangular angle. These antenna can be used in whatever of the configuration presented in the previous figures and it will be noticed by those skilled in the art the same kind of transformation on the opening angles can be applied to any other multilevel structure.

The different applications (FM, DAB, Wireless Car Aperture, Tire pressure control, DVB, GSM900/AMPS, GSM1800/DCS/PCS/DEC, UMTS, Bluetooth, GPS, or WLAN) featured by a multiservice antenna do not necessarily have a constant relation factor two. In the configuration presented in FIG. 10, the reduction factor is different from 2 as an example of a method to tune the antenna to different frequency bands.

Other preferred embodiment are presented in FIGS. 11 and 12 where the constitutive element is triangular.

From FIGS. 13 to 15, other multiservice antennas defined by square element are presented. In each figures, the antenna is represented in the different configurations presented described previously. The square-based multilevel structure can be chosen as an alternative to triangular shapes whenever polarization diversity schemes are to be introduced to compensate the signal fading due to a rapidly changing multipath propagation environment.

Having illustrated and described the principles of our invention in several preferred embodiments thereof, it should be readily apparent to those skilled in the art that the invention can be modified in arrangement and detail without departing from such principles. We claim all modifications coming within the spirit and scope of the accompanying claims.

What is claimed is:

1. An antenna for a motor vehicle comprising:

a) a transparent window coated with an optically transparent conducting layer on at least one side of the transparent window, b) at least one multilevel structure supported by said transparent conducting layer, said at least one multilevel structure composed of a set of polygonal elements having the same number of sides and being electromagnetically coupled either by ohmic contact or a capacitive or inductive coupling mechanism, wherein the contact region between at least 75% of said polygonal elements is between 5% and 50% of the perimeters of said polygonal elements, c) a two-conductor feeding transmission line, connected to said antenna at a feeding point, wherein the antenna features a similar impedance at the feeding point and a similar horizontal radiation pattern in at least three bands, and wherein at least two of said three bands are selected from the group consisting of: FM (80 MHz–110 MHz), DAB (205 MHz–230 MHz), Tetra (350 MHz–450 MHz), DVB (470 MHz–862 MHz), GSM900/AMPS (820 MHz–970 MHz), GSM1800/DCS/PCS/DECT (1700 MHz–1950 MHz), UMTS (1920 MHz–2200 MHz), Bluetooth (2500 MHz) and WLAN (4.5 GHz–6 GHz) such that said antenna can be operated simultaneously at any of the telecommunication services with said bands.

2. The antenna for a motor vehicle as claimed in claim 1, wherein said at least one multilevel structure is a solid-shape structure with the transparent conducting layer filling the inside area of the polygonal elements of said multilevel structure, and wherein the rest of the window surface is not coated with said conducting layer.

3. The antenna for a motor vehicle as claimed in claim 1, wherein the transparent conducting layer defines a grid composed of the perimeter of the polygonal elements of said at least one multilevel structure, and wherein the rest of the window surface is not coated with said conducting layer.

4. The antenna for a motor vehicle as claimed in claim 1, wherein the transparent conducting layer covers most of the transparent window, the at least one multilevel structure is formed as a negative image in the transparent conducting layer where the transparent conducting layer is not present on the transparent window, and wherein the border of the transparent window optionally remains uncoated.

5. The antenna for a motor vehicle as claimed in claim 1, wherein the perimeters of the polygonal elements of said at least one multilevel structure define a slot antenna impressed on said transparent conducting layer.

6. The antenna for a motor vehicle as claimed in claim 1, wherein a first side of the transparent window is coated with said transparent conducting layer to form a first multilevel structure, wherein a second, opposite side of the transparent window is coated with the complimentary structure of said first multilevel structure to form a second multilevel structure, in such a way that the uncoated areas in said first multilevel structure are coated in said second multilevel structure, and the coated areas in said first multilevel structure are uncoated in said second multilevel structure.

7. The antenna for a motor vehicle as claimed in claim 1 wherein said at least one multilevel structure approximates an ideal Sierpinski triangle with at least three scale levels, the several scale levels of the structure being tuned at least three frequencies within three bands selected from the group consisting of: FM (80 MHz–110 MHz), DAB (205 MHz–230 MHz), Tetra (350 MHz–450 MHz), DVB (470 MHz–862 MHz), GSM900/AMPS (820 MHz–970 MHz), GSM1800/DCS/PCS/DECT/(1700 MHz–1950 MHz), UMTS (1950 MHz–2200 MHz), Bluetooth (2500 MHz) and WLAN (4.5 GHz–6 GHz) such that said antenna can be operated simultaneously at any of the telecommunication services within said bands.

8. The antenna for a motor vehicle as claimed in claim 7, wherein said at least one multilevel structure contains at least six scale-levels tuned to operate at least at the six following bands: FM (80 MHz–110 MHz), DAB (205 MHz–230 MHz), Tetra (350 MHz–450 MHz), GSM900/AMPS (820 MHz–970 MHz), GSM1800/DCS/PCS/DECT (1700 MHz–1950 MHz) Bluetooth (2500 MHz) and UMTS (1950 MHz–2200 MHz).

9. The antenna for a motor vehicle as claimed in claim 1 wherein the multilevel structure is loaded with a reactive structure impressed on the same transparent conducting layer as the multilevel structure.

10. The antenna for a motor vehicle as claimed in claim 1 wherein said transparent conducting layer is formed from a material selected from the group consisting of: ZnO, ITO, $SnO_2$ and combinations thereof.

11. The antenna for a motor vehicle as claimed in claim 1 wherein said antenna includes a multilevel structure composed of squared elements, wherein said square geometry is used to obtain polarization diversity within the same antenna by feeding said antenna with at least two ports, said ports being defined by two conductors, and wherein half of the ports are located in a point of the symmetry axis of the structure and the other half of the ports are located in a point of the other orthogonal symmetry axis.

12. The antenna for a motor vehicle as claimed in claim 5, wherein said transparent conducting layer is optionally used to protect the interior of the motor vehicle from heating due to incoming infrared radiation.

13. The antenna for a motor vehicle as claimed in claim 6, wherein said first and second transparent conducting layers are optionally used to protect the interior of the motor vehicle interior from heating due to incoming infrared radiation.

14. The antenna for a motor vehicle as claimed in claim 1, wherein there are at least two multilevel structures supported by said transparent conducting layer, wherein said at least two multilevel structures are used for space polarization, diversity polarization, or a combination of space and polarization diversity for at least one of the telecommunication services operating with said antenna.

15. The antenna for a motor vehicle as claimed in claim 1, wherein said polygonal elements have at least three sides.

16. The antenna for a motor vehicle as claimed in claim 1, wherein said polygonal elements have at least four sides.

17. The antenna for a motor vehicle as claimed in claim 1, wherein said polygonal elements have at least five sides.

18. The antenna for a motor vehicle as claimed in claim 3, wherein said grid is used as a heating defrosting structure for said transparent window.

19. An antenna for a motor vehicle comprising:

a) a transparent window coated with an optically transparent conducting layer on at least one side of the transparent window, b) at least one multilevel structure supported by said transparent conducting layer, said at least one multilevel structure composed of a set of polygonal elements having the same number of sides and being electromagnetically coupled either by ohmic contact or a capacitive or inductive coupling mechanism, wherein the contact region between at least 75% of said polygonal elements is less than 50% of the perimeters of said polygonal elements, c) a two-conductor feeding transmission line connected to said antenna at a feeding point, wherein the antenna features a similar impedance at the feeding point and a similar horizontal radiation pattern in at least three bands, and wherein at least two of said three bands are selected from the group consisting of: FM (80 MHz–110 MHz), DAB (205 MHz–230 MHz), Tetra (350 MHz–450 MHz) GSM900/AMPS (820 MHz–970 MHz), GSM1800/DCS/PCS/DECT (1700 MHz–1950 MHz), UMTS (1950 MHz–2200 MHz), Bluetooth (2500 MHz) and WLAN (4.5 GHz–6 GHz) such that said antenna can be operated simultaneously at any of the telecommunication services with said bands.

20. The antenna for a motor vehicle as claimed in claim 19, wherein said at least one multilevel structure is a solid-shape structure with the transparent conducting layer filling the inside area of the polygonal elements of said multilevel structure, and wherein the rest of the window surface is not coated with said conducting layer.

21. The antenna for a motor vehicle as claimed in claim 19, wherein the transparent conducting layer defines a grid composed of the perimeter of the polygonal elements of said at least one multilevel structure, and wherein the rest of the window surface is not coated with said conducting layer.

22. The antenna for a motor vehicle as claimed in claim 19, wherein the transparent conducting layer covers most of the transparent window, the at least one multilevel structure is formed as a negative image in the transparent conducting layer where the transparent conducting layer is not present on the transparent window, and wherein the border of the transparent window optionally remains uncoated.

23. The antenna for a motor vehicle as claimed in claim 19, wherein the perimeters of the polygonal elements of said at least one multilevel structure define a slot antenna impressed on said transparent conducting layer.

24. The antenna for a motor vehicle as claimed in claim 19, wherein a first side of the transparent window is coated with said transparent conducting layer to form a first multilevel structure, wherein a second, opposite side of the transparent window is coated with the complimentary structure of said first multilevel structure to form a second multilevel structure, in such a way that the uncoated areas in said first multilevel structure are coated in said second multilevel structure, and the coated areas in said first multilevel structure are uncoated in said second multilevel structure.

25. The antenna for a motor vehicle as claimed in claim 19 wherein said at least one multilevel structure approximates an ideal Sierpinski triangle with at least three scale levels, the several scale levels of the structure being tuned at least three frequencies within three bands selected from the group consisting of: FM (80 MHz–110 MHz), DAB (205 MHz–230 MHz), Tetra (350 MHz–450 MHz), DVB (470 MHz–826 MHz), GSM900/AMPS (820 MHz–970 MHz), GSM1800/DCS/PCS/DECT (1700 MHz–1950 MHz), UMTS (1920 MHz–2200 MHz), Bluetooth (2500 MHz) and WLAN (4.5 GHz–6 GHz) such that said antenna can be operated simultaneously at any of the telecommunication services with said bands.

26. The antenna for a motor vehicle as claimed in claim 25, wherein said at least one multilevel structure contains at least six scale-levels tuned to operate at least at the six following bands: FM (80 MHz–110 MHz), DAB (205 MHz–230 MHz), Tetra (350 MHz–450 MHz) GSM900/AMPS (820 MHz–970 MHz), GSM1800/DCS/PCS/DECT (1700 MHz–1950 MHz), Bluetooth (2500 MHz) and UMTS (1920 MHz–2200 MHz).

27. The antenna for a motor vehicle as claimed in claim 19 wherein the multilevel structure is loaded with a reactive structure impressed on the same transparent conducting layer as the multilevel structure.

28. The antenna for a motor vehicle as claimed in claim 19 wherein said transparent conducting layer is formed from a material selected from the group consisting of: ZnO, ITO, $SnO_2$ and combinations thereof.

29. The antenna for a motor vehicle as claimed in claim 19 wherein said antenna includes a multilevel structure composed of squared elements, wherein said square geometry is used to obtain polarization diversity within the same antenna by feeding said antenna with at least two ports, said ports being defined by two conductors, and wherein half of the ports are located in a point of the symmetry axis of the structure and the other half of the ports are located in a point of the other orthogonal symmetry axis.

30. The antenna for a motor vehicle as claimed in claim 23, wherein said transparent conducting layer is optionally used to protect the interior of the motor vehicle from heating due to incoming infrared radiation.

31. The antenna for a motor vehicle as claimed in claim 24, wherein said first and second transparent conducting layers are optionally used to protect the interior of the motor vehicle interior from heating due to incoming infrared radiation.

32. The antenna for a motor vehicle as claimed in claim 19, wherein there are at least two multilevel structures supported by said transparent conducting layer, wherein said at least two multilevel structures are used for space polarization, diversity polarization, or a combination of space and polarization diversity for at least one of the telecommunication services operating with said antenna.

33. The antenna for a motor vehicle as claimed in claim 19, wherein said polygonal elements have at least three sides.

34. The antenna for a motor vehicle as claimed in claim 19, wherein said polygonal elements have at least four sides.

35. The antenna for a motor vehicle as claimed in claim 19, wherein said polygonal elements have at least five sides.

36. The antenna for a motor vehicle as claimed in claim 21, wherein said grid is used as a heating defrosting structure for said transparent window.

* * * * *

UNITED STATES PATENT AND TRADEMARK OFFICE

CERTIFICATE OF CORRECTION

PATENT NO. : 6,809,692 B2
DATED : October 26, 2004
INVENTOR(S) : Puente Baliarda et al.

It is certified that error appears in the above-identified patent and that said Letters Patent is hereby corrected as shown below:

Column 9,
Lines 33 and 44, delete "1950" and insert -- 1920 --.

Column 10,
Line 40, delete "GSM900/AMPS" insert -- DVB (470 MHz- 862 MHz) --.
Line 42, delete "1950" and insert -- 1920 --.

Column 11,
Line 19, delete "826" and insert -- 862 --.

Signed and Sealed this

Twelfth Day of April, 2005

JON W. DUDAS
*Director of the United States Patent and Trademark Office*